US008437491B2

(12) United States Patent
Ward

(10) Patent No.: US 8,437,491 B2
(45) Date of Patent: May 7, 2013

(54) MICROPHONE SHIELD DEVICE

(76) Inventor: Ramone C. Ward, West Babylon, NY (US)

( * ) Notice: Subject to any disclaimer, the term of this patent is extended or adjusted under 35 U.S.C. 154(b) by 1226 days.

(21) Appl. No.: 11/904,197

(22) Filed: Sep. 26, 2007

(65) Prior Publication Data

US 2008/0089546 A1 Apr. 17, 2008

Related U.S. Application Data

(60) Provisional application No. 60/847,237, filed on Sep. 26, 2006.

(51) Int. Cl.
*H04R 25/00* (2006.01)

(52) U.S. Cl.
USPC ..... 381/376; 381/355; 381/375

(58) Field of Classification Search ..... 381/355, 381/375, 376
See application file for complete search history.

(56) References Cited

U.S. PATENT DOCUMENTS

| | | | | |
|---|---|---|---|---|
| 5,603,117 | A * | 2/1997 | Hudner et al. | 2/6.6 |
| 6,510,311 | B1 * | 1/2003 | Stitt | 455/90.3 |
| 2007/0012507 | A1 * | 1/2007 | Lyon | 181/126 |

* cited by examiner

*Primary Examiner* — Minh-Loan T Tran
*Assistant Examiner* — Fazli Erdem
(74) *Attorney, Agent, or Firm* — Carter, Deluca, Farrell & Schmidt, LLP

(57) ABSTRACT

A microphone shield device includes a microphone shield plate, a shield plate arm connected at a first end thereof to the microphone shield plate, and means for attaching a second end of the shield plate arm to a microphone headset in a manner which at least partially obscures an ability to view a microphone headset user's mouth while the user is speaking into the microphone headset.

4 Claims, 7 Drawing Sheets

MICROPHONE SHIELD DEVICE

CROSS-REFERENCE TO RELATED APPLICATIONS

This application claims the benefit of U.S. Provisional Patent Application No. 60/847,237, filed Sep. 26, 2006.

BACKGROUND OF THE INVENTION

1. Field of the Invention

The present invention relates to apparatus for use with microphone headset systems, and, more specifically, to a shield which attaches to the microphone headset to prevent lip reading.

2. Description of the Background Art

In general, the use of headset microphone systems is known in the art. In particular, the use of headset microphone systems is very common in sporting events, such as football, to permit communication between coaches, managers and players. In other sporting events such as car racing, the use of headset microphone systems allows communication between the support staff and the participant (i.e., the pit crew and the driver).

However, in each of these sports, although the headset microphone systems provide a necessary and convenient means of communication, the systems are not without disadvantages. One of the main disadvantages is that as the user of the microphone system speaks into the microphone his or her adversary or opponent may be able to read the lips of the user and thereby gain valuable information that will give the opposing team an unfair advantage. For example, during a football game the coach will speak into the microphone to instruct his quarterback regarding the next play call. If the opposing team is able to read the lips of the coach, then the opposing team would be able to make the appropriate adjustments to defend against the play call, thereby creating an unfair advantage for the defensive team. Similarly, in car racing, if other drivers and pit crews knew of the intentions of their opponents, they would be able to plan accordingly.

Another disadvantage encountered with the use of microphone headset systems is the inability to overcome the noise on system created by either the surroundings or the wind. Many times the systems are used outside in windy environments and in stadiums with a lot of noisy fans.

Accordingly, there is a need in the art for a device that will provide the user with protection from external noise factors and provide the user with the protection from having his or her opponents from obtaining critical information.

SUMMARY OF THE INVENTION

It is an object of the present invention to provide a microphone shield device which is dimensioned and configured to shield the lips of the user so that the movement of the lips cannot be readily detected and/or read by another person. It is contemplated that the microphone shield device may be configured in any shape (e.g., a circle, an oval, a square, a rectangle, etc.) or size.

A microphone headset system typically includes a microphone, a speaker and a head strap. An arm connects the speaker and microphone. A first end of the arm is pivotally mounted about a point along the axis of speaker. Thus, the user is capable of pivoting the microphone in and out of position in front of the mouth of the user.

A microphone shield device includes a microphone shield plate, a shield plate arm and a microphone shield device attachment clip. The shield plate arm connects at a first end to shield plate and is pivotally connected at a second end to a pivot point on a first end of microphone shield device attachment clip. Accordingly, the user is able to pivot the microphone shield device in and out of position in front of microphone. Furthermore, the microphone shield device attachment clip may be configured to attach the microphone shield device at numerous positions along the arm of the microphone headset system. Thus, the user may position the microphone shield device in a plurality of positions on the microphone headset system to provide the maximum amount of benefit that may be achieved.

The invention is not limited to the above-described embodiments, and various changes are possible without departing from the principles set forth herein. Furthermore, the embodiments include the invention at various stages, and various inventions can be extracted by properly combining multiple disclosed constructional requirements. There are many applications of this design.

The above is a brief description of some deficiencies in the prior art and advantages of the present invention. Other features, advantages and embodiments of the invention will be apparent to those skilled in the art from the following description, drawings.

BRIEF DESCRIPTION OF THE DRAWINGS

The invention will become more clearly understood from the following detailed description in connection with the accompanying drawings, in which.

DETAILED DESCRIPTION OF THE PREFERRED EMBODIMENTS

The following description is presented to enable one of ordinary skill in the art to make and use the invention and is provided in the context of a patent application and its requirements. Various modifications to the preferred embodiments will be readily apparent to those skilled in the art and the generic principles herein may be applied to other embodiments. Thus, the present invention is not intended to be limited to the embodiment shown but is to be accorded the widest scope consistent with the principles and features described herein.

Figure 1:
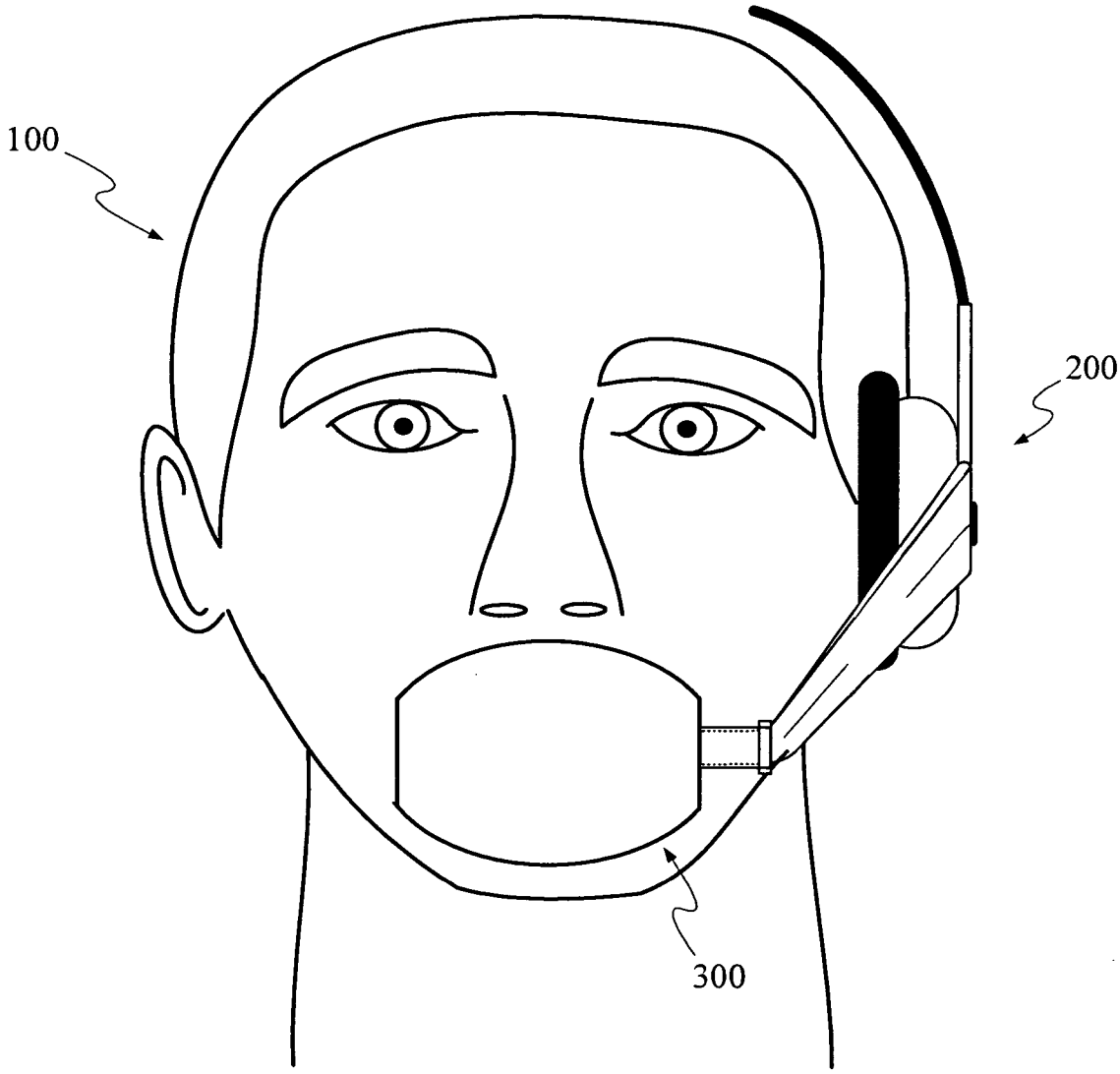
FIG. 1 is a front view illustrating a user wearing a microphone headset system having a microphone shield device mounted thereon, in accordance with an embodiment of the present invention.

Referring now to the drawings in detail, and first to FIG. 1, a user 100 is illustrated wearing a microphone headset system 200 having a microphone shield device 300 mounted thereon, in accordance with an embodiment of the present invention. As illustrated in FIG. 1, the microphone shield device 300 is dimensioned and configured to shield the lips of the user 100 so that the movement of the lips cannot be readily detected and/or read by another person. The microphone shield device 300 is illustrated in a particular shape. However, it is contemplated that the microphone shield device 300 may be configured in any shape (e.g., a circle, an oval, a square, a rectangle, etc.) or size.

Figure 2:
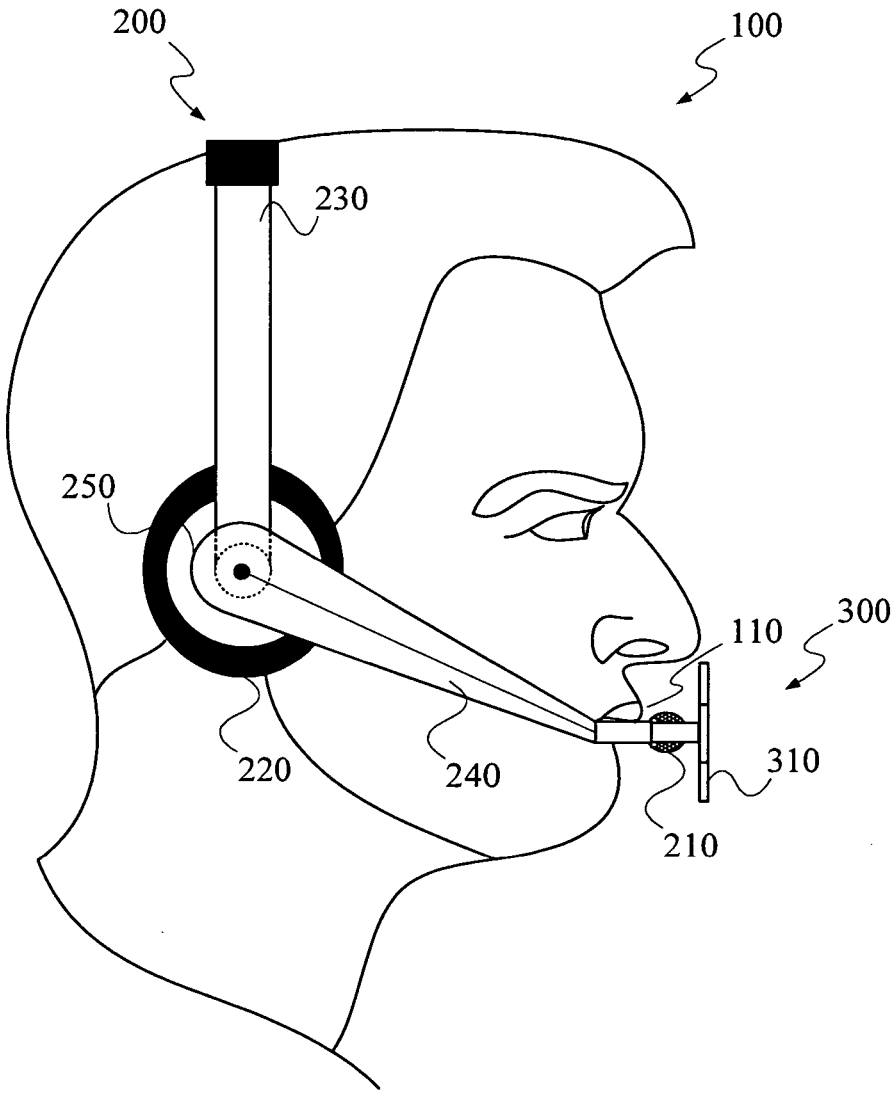
FIG. 2 is a side view illustrating a user wearing a microphone headset system having a microphone shield device mounted thereon, in accordance with an embodiment of the present invention.

FIG. 2 is a side view illustrating a user 100 wearing a microphone headset system 200 having a microphone shield device 300 mounted thereon, in accordance with an embodiment of the present invention. The microphone headset system typically includes a microphone 210, a speaker 220 and a head strap 230. An arm 240 connects the speaker 220 and microphone 210. A first end 250 of arm 240 is pivotally mounted about a point along the axis of speaker 220. Thus, the user 100 is capable of pivoting the microphone 210 in and out of position in front of the mouth 110 of the user 100.

Another advantage of the present invention is illustrated in FIG. 2. That is, the microphone is shielded from its surroundings by shield plate 310, thereby minimizing noise that would otherwise be created by wind hitting the microphone.

Figure 3:
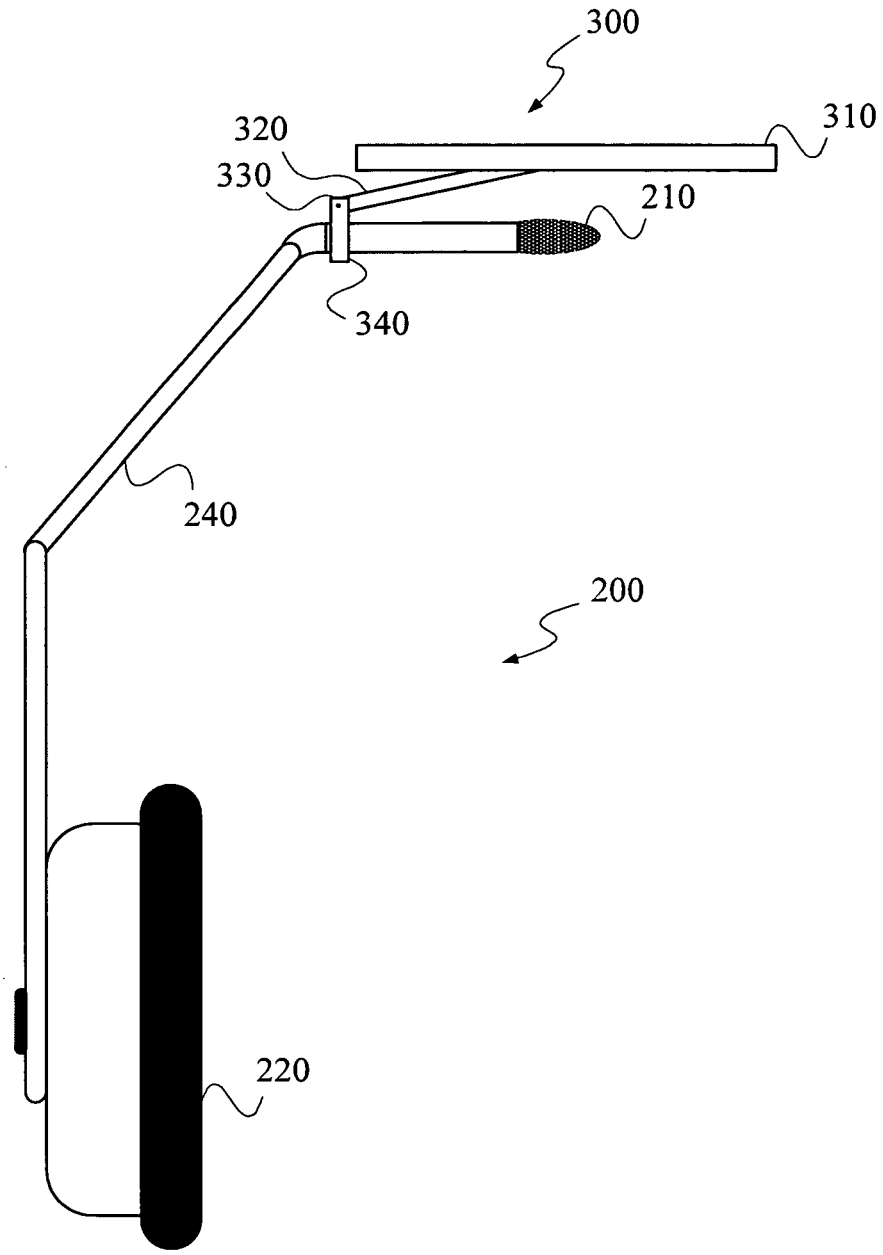
FIG. 3 is a top view illustrating a microphone headset system having a microphone shield device mounted thereon, in accordance with an embodiment of the present invention.

Referring now to FIG. 3, there is shown a top view illustrating a microphone headset system 200 having a microphone shield device 300 mounted thereon, in accordance with an embodiment of the present invention. As illustrated, the microphone shield device 300 includes a microphone shield plate 310, a shield plate arm 320 and a microphone shield device attachment clip 340. The shield plate arm 320 connects at a first end to shield plate 310 and is pivotally connected at a second end to a pivot point 330 on a first end of microphone shield device attachment clip 340. Accordingly, the user is able to pivot the microphone shield device in and out of position in front of microphone 210. Furthermore, microphone shield device attachment clip 340 may be configured to attach the microphone shield device 300 at numerous positions along arm 240 of the microphone headset system 200. Thus, the user may position the microphone shield device in a plurality of positions on the microphone headset system to provide the maximum amount of benefit that may be achieved.

Figure 4:
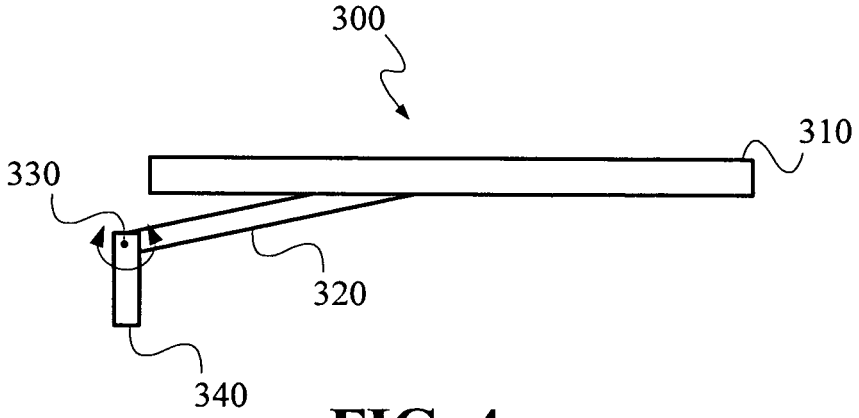
FIG. 4 is a top plan view illustrating one of the articulating features of a microphone shield device in accordance with an embodiment of the present invention.
Figure 5:
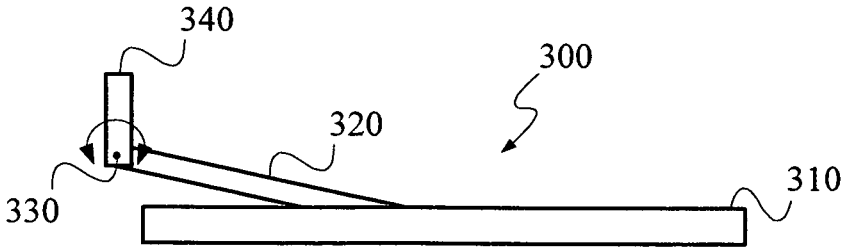
FIG. 5 is a top plan view illustrating one of the articulating features of a microphone shield device in accordance with an embodiment of the present invention.

FIGS. 4 and 5 are top plan views illustrating the articulating features of the microphone shield device 300 in accordance with an embodiment of the present invention. As shown in FIGS. 4 and 5, the shield plate arm 320 connects at a first end to shield plate 310 and is pivotally connected at a second end to a pivot point 330 on a first end of microphone shield device attachment clip 340. Accordingly, the user is able to pivot the microphone shield device in and out of position in front of a microphone.

Figure 6:
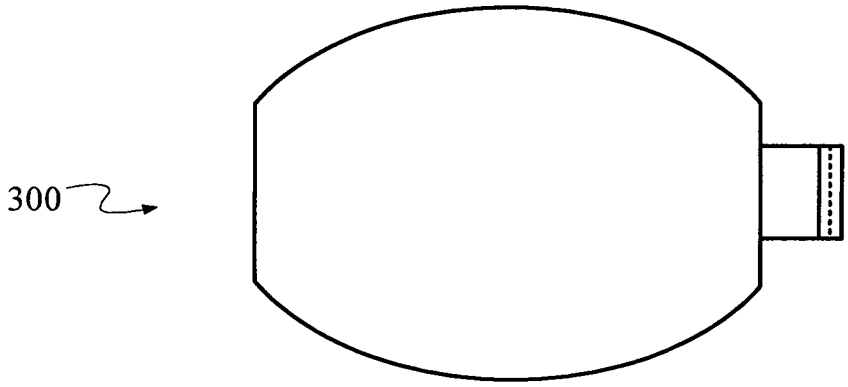
FIG. 6 is a front view of an embodiment of a microphone shield device in accordance with an embodiment of the present invention.
Figure 7:
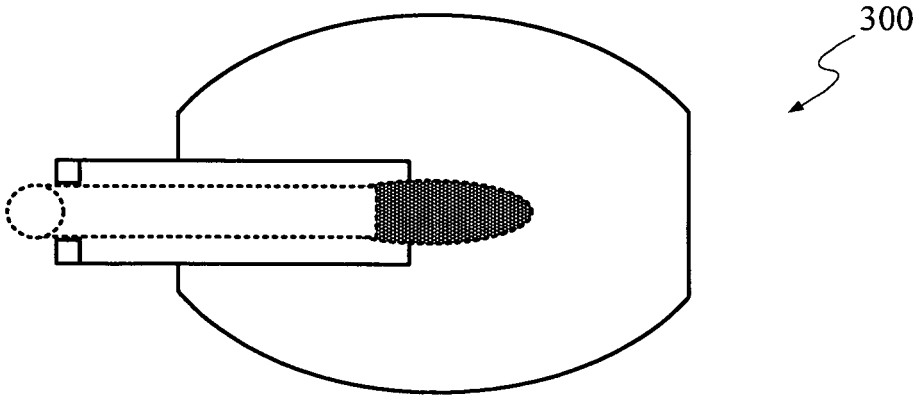
FIG. 7 is a rear view of an embodiment of a microphone shield device in accordance with an embodiment of the present invention.
Figure 8:
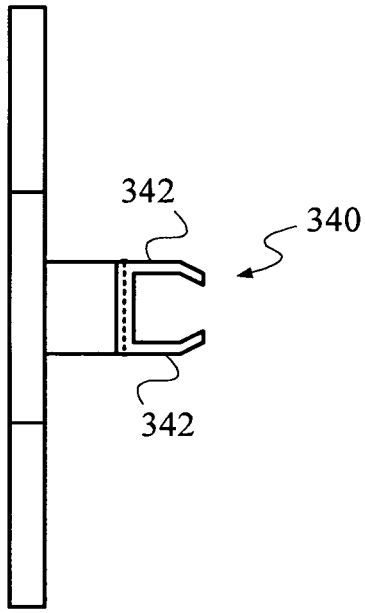
FIG. 8 is a side view illustrating an embodiment a means for attaching a microphone shield device in accordance with an embodiment of the present invention.
Figure 9:
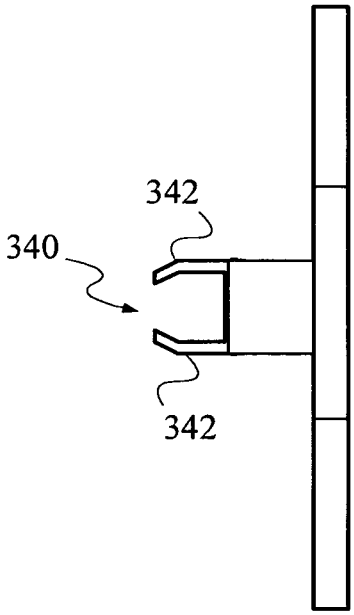
FIG. 9 is a side view illustrating an embodiment a means for attaching a microphone shield device in accordance with an embodiment of the present invention.

FIGS. 6 and 7 are front and rear views, respectively, of a microphone shield device 300 in accordance with an embodiment of the present invention. FIGS. 8 and 9 are side views illustrating an embodiment a means for attaching a microphone shield device in accordance with an embodiment of the present invention. As illustrated, this embodiment of a means for attaching a microphone shield device comprises a clip 340 having a pair of resilient legs 342. The legs 342 are configured to deflect and return to their original position to attach to a tubular structure, for example.

Figure 10:
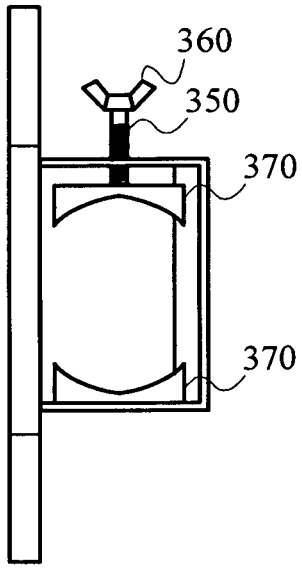
FIG. 10 is a side view illustrating an embodiment a means for attaching a microphone shield device in accordance with an embodiment of the present invention.
Figure 11:
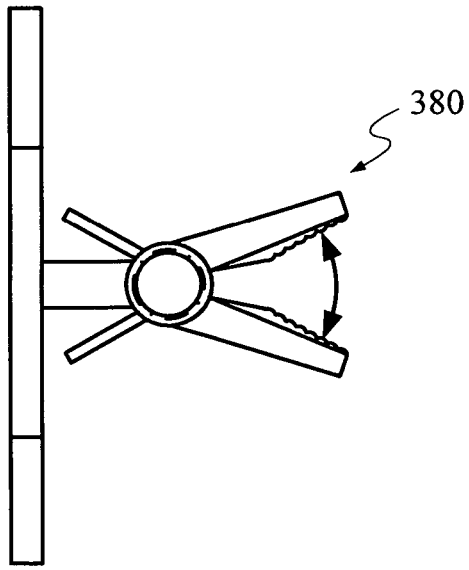
FIG. 11 is a side view illustrating an embodiment a means for attaching a microphone shield device in accordance with an embodiment of the present invention.

FIGS. 10 and 11 illustrate two alternative means for attaching a microphone shield device in accordance with the present invention. More specifically, the attaching device in FIG. 10 includes a clamping device having a threaded rod 350 with a wing nut 360 connected thereto. At least one of the two clamp halves 370 is driven toward the opposing clamp half to secure the microphone shield device to a microphone headset system. The threaded rod 350 may be secured in place by tightening the wing nut 360. FIG. 11 illustrates a spring loaded clamp device 380 for attaching a microphone shield device to a microphone headset system.

Although the present invention has been described in accordance with the embodiments shown, one of ordinary skill in the art will readily recognize that there could be variations to the embodiment and these variations would be within the spirit and scope of the present invention. Accordingly, many modifications may be made by one of ordinary skill in the art without departing from the spirit and scope of the invention.

What is claimed is:

1. A microphone shield device comprising:

a microphone shield plate;

a shield plate arm connected at a first end thereof to the microphone shield plate; and means for attaching a second end of the shield plate arm to a microphone headset;

wherein the means for attaching the second end of the shield plate arm to a microphone headset comprises a microphone shield device attachment clip, the attachment clip having a pair of resilient legs configured to deflect to releasably attach the microphone shield plate to a microphone headset.

2. The microphone shield device as recited in claim 1 wherein the shield plate arm is pivotally connected at the second end thereof to the means for attaching.

3. The microphone shield device as recited in claim 1 wherein the microphone shield plate is configured in a shape of at least one of a circle, an oval, a square and a rectangle.

4. The microphone shield device as recited in claim 1 wherein the microphone shield plate is attached to a microphone headset in a manner which at least partially obscures an ability to view a microphone headset user's mouth while the user is speaking into the microphone headset.

* * * * *